US005401921A

United States Patent [19]

D'Antonio et al.

[11] Patent Number: 5,401,921

[45] Date of Patent: Mar. 28, 1995

[54] TWO-DIMENSIONAL PRIMITIVE ROOT DIFFUSOR

[75] Inventors: Peter D'Antonio, Upper Marlboro, Md.; John H. Konnert, Reston, Va.

[73] Assignee: RPG Diffusor Systems, Inc., Upper Marlboro, Md.

[21] Appl. No.: 120,073

[22] Filed: Sep. 13, 1993

[51] Int. Cl.[6] ..... E04B 1/82

[52] U.S. Cl. ..... 181/286; 181/288; 181/295; 181/296

[58] Field of Search ..... 181/30, 285, 286, 288, 181/294, 295, 296

[56] References Cited

U.S. PATENT DOCUMENTS

| | | | |
|---|---|---|---|
| 4,821,839 | 4/1989 | D'Antonio et al. | 181/286 X |
| 4,964,486 | 10/1990 | D'Antonio et al. | 181/286 X |
| 5,027,920 | 7/1991 | D'Antonio et al. | 181/286 X |
| 5,160,816 | 11/1992 | Chlop | 181/285 |
| 5,168,129 | 12/1992 | D'Antonio | 181/30 |
| 5,193,318 | 3/1993 | D'Antonio et al. | 181/285 X |
| 5,226,267 | 7/1993 | D'Antonio et al. | 181/286 X |

*Primary Examiner*—Michael L. Gellner
*Assistant Examiner*—Khanh Dang
*Attorney, Agent, or Firm*—H. Jay Spiegel

[57] ABSTRACT

A two-dimensional primitive root diffusor includes a two-dimensional pattern of wells, the depths of which are determined through operation of primitive root sequence theory. A prime number N is chosen such that N−1 has two coprime factors which are non-divisible into each other. From the prime number, a primitive root is determined and, in the preferred embodiment, an algorithm is used to determine sequence values for each well. Each sequence value is proportional to the well depth, with each sequence value being multiplied by the design wavelength and then divided by 2N to arrive at the actual well depth value.

14 Claims, 10 Drawing Sheets

ISOMETRIC VIEW

FIG. 2 PRIOR ART
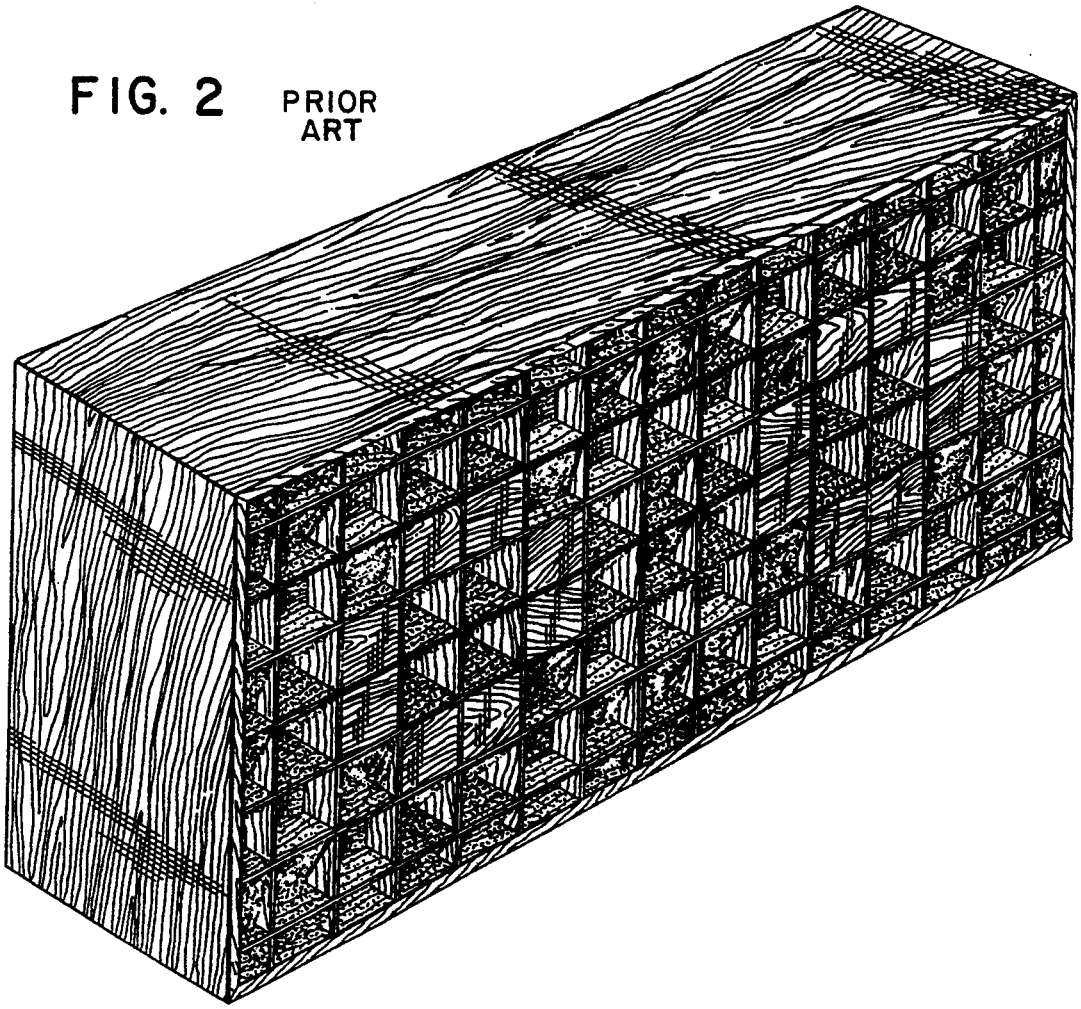
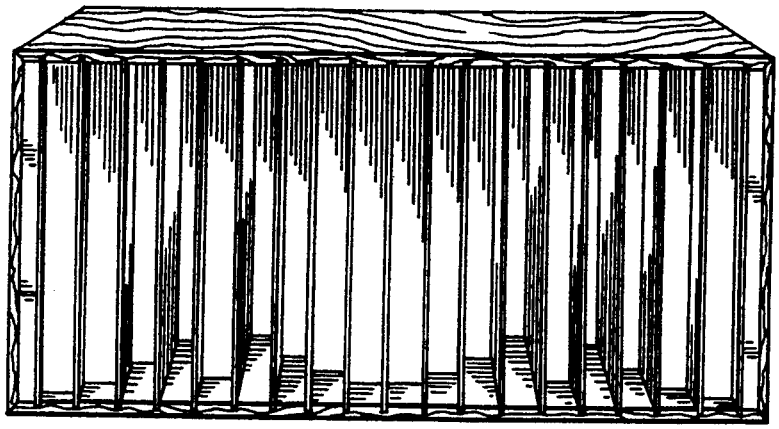
FIG. 1 PRIOR ART

TWO-DIMENSIONAL PRIMITIVE ROOT DIFFUSOR

BACKGROUND OF THE INVENTION

The acoustical analog of the diffraction grating, which has played an important part in spectroscopy for over 100 years, was not used in architectural acoustics until the invention and development of the reflection-phase grating diffusor, within the past decade. The one-dimensional reflection-phase grating, described in U.S. Pat. No. D291,601 and shown in FIG. 1, consists of a linear periodic grouping of an array of wells of equal width, but different depths, separated by thin dividers. The depths of the wells are determined through calculations using the quadratic residue number theory. In a one-dimensional reflection-phase grating, the number theoretic phase variation occurs in one direction on the face of the unit and is invariant 90° from that direction. The reflection-phase grating can also be designed in a two-dimensional realization where the number theoretic phase variation occurs in two orthogonal directions, as opposed to in only one. As in the case of the one-dimensional diffusor, quadratic-residue well depth sequences have been used. A two-dimensional diffusor consists of a two-dimensional array of square, rectangular or circular wells of varying depths, separated by thin dividers. FIG. 2 shows a two-dimensional quadratic-residue diffusor, marketed under the Registered Trademark "Omniffusor", which is described in U.S. Pat. No. D306,764. It can be seen that the "Omniffusor" diffusor possesses two vertical mirror planes of symmetry and four-fold rotational symmetry, while, as will be explained in detail hereinafter, the primitive root diffusor contains no symmetry elements.

A schematic comparison between the hemidisk coverage pattern of a one-dimensional quadratic-residue diffusor and the hemispherical coverage pattern of a two-dimensional quadratic-residue diffusor is shown in FIGS. 3 and 4, respectively. In FIG. 3, the incident plane wave is indicated with arrows arriving at 45° with respect to the surface normal. The radiating arrows touching the hemidisk envelope indicate the diffraction directions. In FIG. 4, the incident plane wave is indicated with arrows arriving at 45° with respect to the surface normal. The arrows radiating from the hemisphere envelope indicate a few of the many diffraction directions.

While the quadratic-residue sequences provide uniform diffusion in all of the diffraction orders, the primitive root sequence suppresses the zero order and the Zech logarithm suppress the zero and first diffraction orders, at the design frequency and integer multiples thereof. Applicants have found that the scattering intensity pattern for the primitive root sequence omits the specular lobe, which lobe is present in the scattering intensity pattern of a quadratic-residue number theory sequence.

$$\sin\alpha_d = \frac{m\lambda}{NW} - \sin\alpha_i \tag{1}$$

$$r_h = \exp\left[-2\pi i \frac{2d_h}{\lambda}\right] \tag{2}$$

$$d_h = S_h \frac{\lambda_0}{2N} \tag{3}$$

-continued $$d_{h,k} = S_{h,k} \frac{\lambda}{2N} \tag{4}$$

The diffraction directions for each wavelength, λ, of incident sound scattered from a reflection-phase grating (FIG. 5) are determined by the dimension of the repeat unit NW, Equation 1. N being the number of wells per period, W being the width of the well, $\alpha_i$ being the angle of incidence, $\alpha_d$ being the angle of diffraction, and n being the diffraction order. The intensity in any direction (FIG. 6) is determined by the Fourier transform of the reflection factor, $r_h$, which is a function of the depth sequence ($d_h$) or phases within a period (Equation 2). Equation 1 indicates that as the repeat unit NW increases, more diffraction lobes are experienced and the diffusion increases. In addition, as the number of periods increases, the energy is concentrated into the diffraction directions (FIG. 6).

FIG. 6(top) shows the theoretical scattering intensity pattern for a quadratic-residue diffusor. Diffraction directions are represented as dashed lines; scattering from finite diffusor occurs over broad lobes. Maximum intensity has been normalized to 50 dB. In FIG. 6(middle), the number of periods has been increased from 2 to 25, concentrating energy into diffraction directions. In FIG. 6(bottom), the number of wells per period has been increased from 17 to 89, thereby increasing number of lobes by a factor of 5. Arrows indicate incident and specular reflection directions.

The reflection-phase grating behaves like an ideal diffusor in that the surface irregularities provide excellent time distribution of the backscattered sound and uniform wide-angle coverage over a broad designable frequency bandwidth, independent of the angle of incidence. The diffusing properties are in effect invariant to the incident frequency, the angle of incidence and the angle of observation.

The well depths for the one-dimensional quadratic-residue diffusor, Equation 3, and the two-dimensional quadratic-residue diffusor, Equation 4, are based on mathematical number-theory sequences, which have the unique property that the Fourier transform of the exponentiated sequence values has constant magnitude in the diffraction directions. The symbol h represents the well number in the one-dimensional quadratic-residue diffusor and the symbols h and k represent the well number in the two-dimensional quadratic-residue diffusor For the quadratic sequence elements, $S_h = h^2{}_{modN}$ and $S_{h,k} = \{h^2 + k^2\}_{modN}$ where N is an odd prime. For example, if N=7, the one-dimensional sequence elements, for h=0−6 are 0,1,4,2,2,4,1. For higher values of h, the sequence repeats. Values of $S_{h,k}$ for N=7 are given in Table 1 for a two-dimensional quadratic-residue diffusor.

TABLE 1

| | | | | | | |
|---|---|---|---|---|---|---|
| 0 | 1 | 4 | 2 | 2 | 4 | 1 |
| 1 | 2 | 5 | 3 | 3 | 5 | 2 |
| 4 | 5 | 1 | 6 | 6 | 1 | 5 |
| 2 | 3 | 6 | 4 | 4 | 6 | 3 |
| 2 | 3 | 6 | 4 | 6 | 3 | 2 |
| 4 | 5 | 1 | 6 | 6 | 1 | 5 |
| 1 | 2 | 5 | 3 | 3 | 5 | 2 |

TABLE 1-continued $$\sqrt{m^2 + n^2} = NW \frac{\sin\alpha_d + \sin\alpha_i}{\lambda} \quad (5)$$

The two-dimensional polar response or diffraction orders (m,n), Equation 5, can be conveniently displayed in a reciprocal lattice reflection phase grating plot, shown in FIG. 7. The diffraction orders are determined by the constructive interference condition.

When the depth variations are defined by a quadratic residue sequence, the non-evanescent scattering lobes are represented as equal energy contours within a circle whose radius is equal to the non-dimensional quantity, $NW/\lambda$. This is a convenient plot because the effects of changing the frequency can easily be seen. Thus, if $\lambda_2$ is decreased to $\lambda_1$, the number of accessible diffraction lobes contained within the circle of radius $NW/\lambda_1$ increases, thereby also increasing the diffusion. A one-dimensional reflection-phase grating with horizontal wells will scatter in directions represented by a vertical line in the reciprocal lattice reflection phase grating (with n=0, ±1, ±2, etc. and m=0) and diffraction from a one-dimensional reflection-phase grating with vertical wells will occur along a horizontal line (with m=0, ±1, ±2, etc. and n=0). A coordinate on the reciprocal lattice reflection phase grating plot is a direction. These scattering directions can be seen in the three-dimensional "banana" plot of FIG. 8, where the nine diffraction orders occurring within a circle of radius $NW/\lambda_2$ are plotted, from a diagonal view perspective. A conventional polar pattern for a one-dimensional reflection-phase grating with vertical wells at $\lambda_2$ is obtained from a planar slice through lobes 0, 2 and 6 in FIG. 8 and would contain orders with m=0 and ±1. The breadth of the scattering lobes is proportional to the number of periods contained in the reflection-phase grating.

SUMMARY OF THE INVENTION

For the primitive-root sequence which is the basis for the present invention, $S_h = g^h{}_{modN}$, where g is the primitive root of N. For N=11, the primitive root g=2. This means that the remainders after dividing $2^h$ by 11, assume all (N−1) $S_h$ values 1,2, . . . 10, exactly once, in a unique permutation. In this case we have 2, 4, 8, 5, 10, 9, 7, 3, 6, 1. For higher values of h, the series is repeated periodically. Since each number appears only once, the symmetry found in the quadratic-residue diffusor is not present in the primitive root diffusor.

The primitive root diffusor has the property that scattering at the design frequency and integer multiples thereof is reduced in the specular direction, due to the fact that the phases are uniformly distributed between 0 and $2\pi$. The one-dimensional diffraction patterns for a primitive root diffusor based on N=53 at normal incidence are shown in FIG. 9. Note the reduced specular lobes at integer multiples of the design frequency, $f_o$.

Applicants have found that to form a two-dimensional primitive root array, the prime number N must be chosen so that N−1 has two coprime factors which are non-divisible into each other. These coprime factors form a two-dimensional matrix when the one-dimensional sequence elements are stored in "Chinese remainder" fashion, which utilizes horizontal and vertical matrix translations. Applicants have found that when this matrix is repeated periodically, consecutive numbers simply follow a −45° diagonal, i.e., $S_1$, $S_2$, $S_3$, $S_4$, etc., which are highlighted in Table 2. This can serve as a check on proper matrix generation. It can be shown that the desirable Fourier properties, namely a flat power response, of the one-dimensional array are present in the two-dimensional array.

TABLE 2

Shows how one-dimensional sequence values, $S_h$, are formed into two periods of an N = 11 primitive root sequence.

| | | | | | | | | | |
|---|---|---|---|---|---|---|---|---|---|
| $S_1 = 2$ | $S_7 = 7$ | $S_3 = 8$ | $S_9 = 6$ | $S_5 = 10$ | $S_1 = 2$ | $S_7 = 7$ | $S_3 = 8$ | $S_9 = 6$ | $S_5 = 10$ |
| $S_6 = 9$ | $S_2 = 4$ | $S_8 = 3$ | $S_4 = 5$ | $S_{10} = 1$ | $S_6 = 9$ | $S_2 = 4$ | $S_8 = 3$ | $S_4 = 5$ | $S_{10} = 1$ |
| $S_1 = 2$ | $S_7 = 7$ | $S_3 = 8$ | $S_9 = 6$ | $S_5 = 10$ | $S_1 = 2$ | $S_7 = 7$ | $S_3 = 8$ | $S_9 = 6$ | $S_5 = 10$ |
| $S_6 = 9$ | $S_2 = 4$ | $S_8 = 3$ | $S_4 = 5$ | $S_{10} = 1$ | $S_6 = 9$ | $S_2 = 4$ | $S_8 = 3$ | $S_4 = 5$ | $S_{10} = 1$ |

Not all primes can be made two-dimensional, since some primes such as N=17, because N−1 does not contain two coprime factors. Two numbers h and k that have no common factors are said to be coprime. As a practical consequence, a two-dimensional primitive root array cannot be square.

Applicants have found that a sound diffusor having wells determined by a primitive root sequence with the wells being arranged as will be explained in greater detail hereinafter following a −45° diagonal, provides a higher ratio of lateral to direct scattered sound compared to the quadratic-residue diffusor. As explained above, diffraction patterns for primitive root diffusors exhibit an absence of the central specularly reflective lobe at the design frequency and at integer multiples thereof. It is the absence of this specularly reflective lobe which provides the indirect sound field of the inventive primitive root diffusors.

Additionally, while diffusors designed in accordance with the quadratic residue number theory sequence have wells having depths which exhibit symmetry about a centerline, in a diffusor made in accordance with primitive root theory, each well has a unique depth different from the depths of other wells. Thus, diffusors made in accordance with the teachings of the present invention are assymetrical since no single well depth is repeated in the entire sequence.

Accordingly, it is a first object of the present invention to provide a two-dimensional primitive root diffusor.

It is a further object of the present invention to provide such a primitive root diffusor with wells which are arranged assymetrically.

It is a still further object of the present invention to provide a primitive root diffusor which provides uniform scattering into lateral directions, while suppressing mirror-like specular reflections, thus increasing the indirect sound field to a listener.

It is a yet further object of the present invention to provide such a diffusor wherein diffraction patterns thereof at the design frequency and at integer multiples thereof exhibit an absence of a specularly reflective lobe.

These and other objects, aspects and features of the present invention will be better understood from the following detailed description of the preferred embodiment when read in conjunction with the appended drawing figures.

BRIEF DESCRIPTION OF THE DRAWINGS

FIG. 1 shows a perspective view of a one-dimensional quadratic-residue diffusor and corresponds to FIG. 1 of Applicants' prior U.S. Pat. No. D291,601.

FIG. 2 shows a perspective view of a two-dimensional quadratic-residue diffusor and corresponds to FIG. 1 of Applicants' prior U.S. Pat. No. D306,764.

FIG. 6(middle) shows the theoretical scattering intensity for a similar diffusor but with the number of periods increased from 2 to 25 thereby concentrating energy into diffraction directions.

FIG. 6(bottom) shows a quadratic-residue diffusor wherein the number of wells per period has been increased from 17 to 89 thereby increasing the number of lobes by a factor of about 5.

SPECIFIC DESCRIPTION OF THE PREFERRED EMBODIMENT

Figure 3:
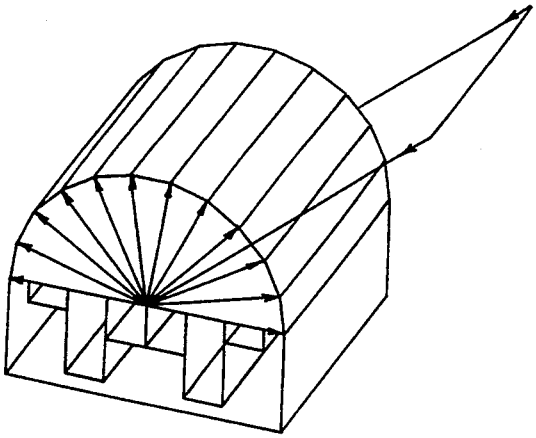
FIG. 3 shows the hemidisk scattering pattern of plane sound waves incident at 45° with respect to a surface normal to a one-dimensional quadratic-residue diffusor.
Figure 4:
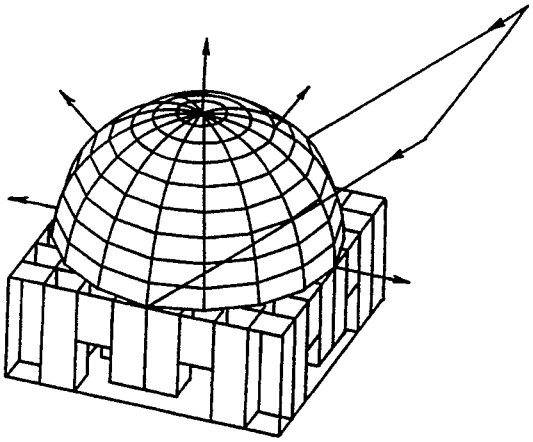
FIG. 4 shows the hemispherical scattering pattern of plane sound waves incident at 45° with respect to a surface normal to a two-dimensional quadratic-residue diffusor.
Figure 5:
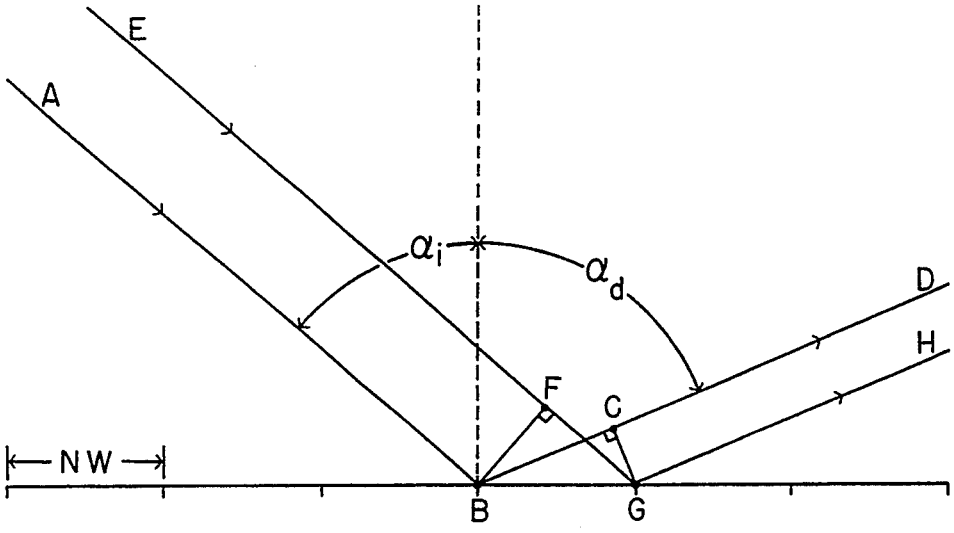
FIG. 5 shows a graph of incident (A and E) and diffracted (D and H) wavelets from a surface of periodic reflection phase grating with repeat distance NW.
Figure 6:
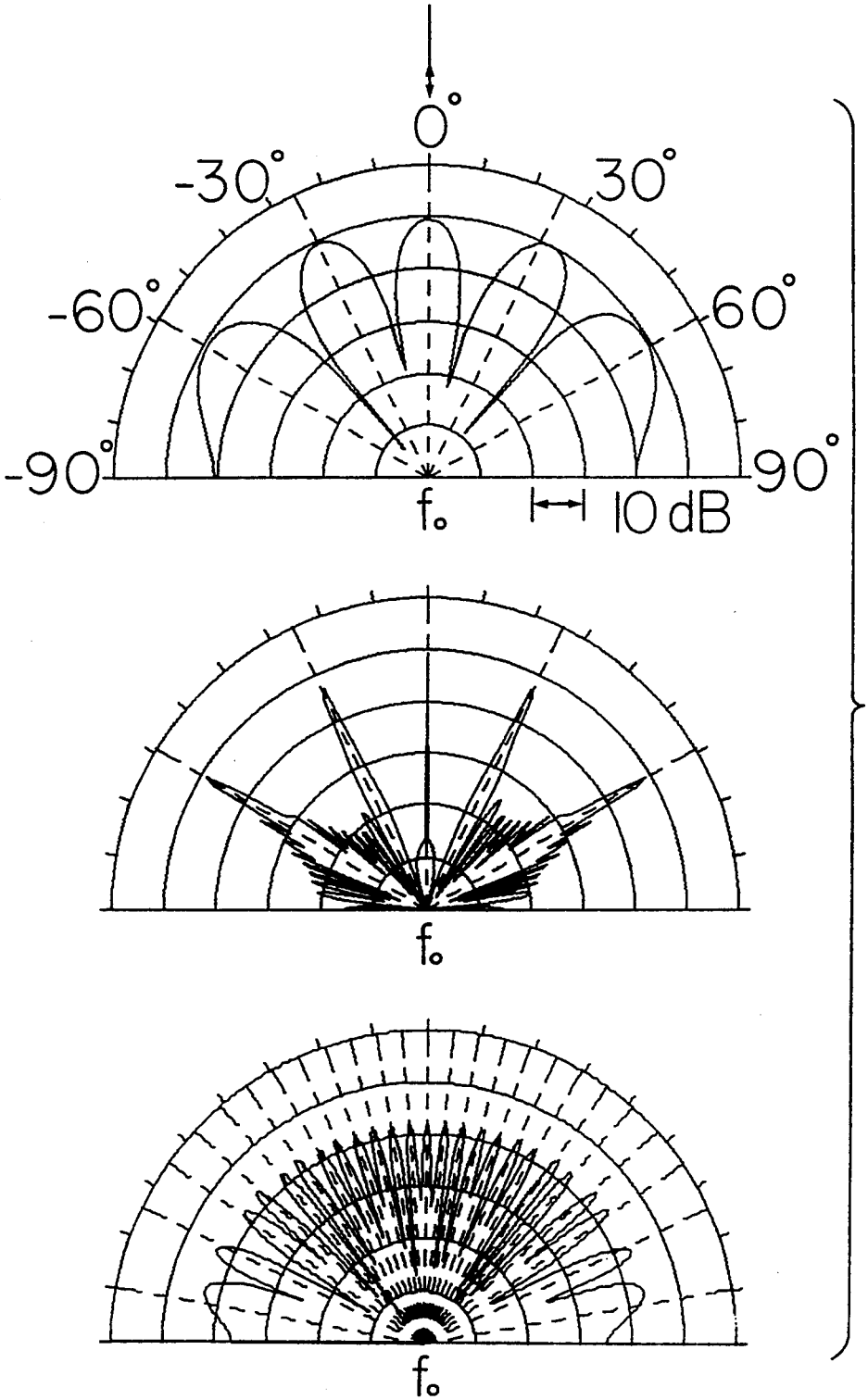
FIG. 6(top) shows the theoretical scattering intensity pattern for a quadratic-residue diffusor with diffraction directions represented as dashed lines and wherein scattering from a finite diffusor occurs over broad lobes.
Figure 7:
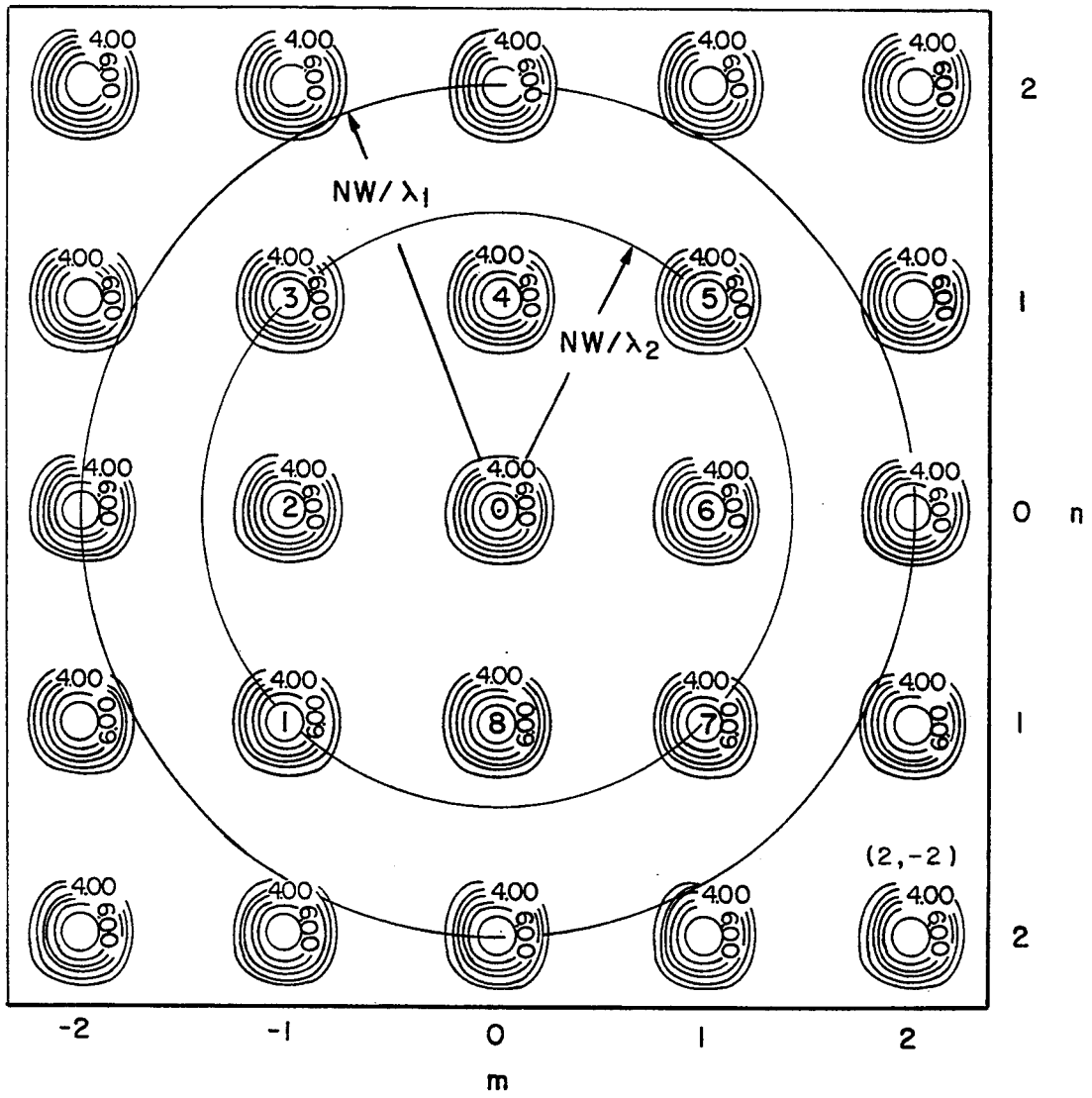
FIG. 7 shows a two-dimensional reciprocal lattice reflection phase grating illustrating equal energy of diffraction orders m and n for the reflection phase grating based upon the quadratic residue number theory sequence.
Figure 8:
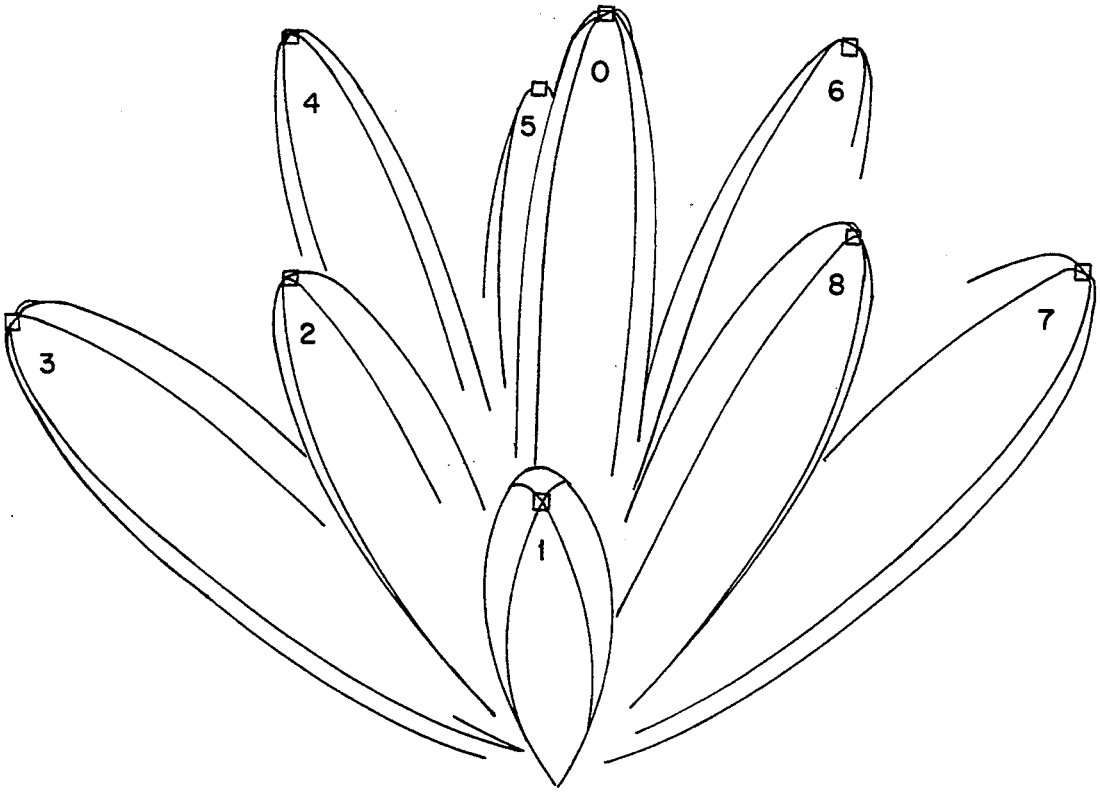
FIG. 8 shows a three-dimensional "banana plot" derived from FIG. 7.
Figure 9:
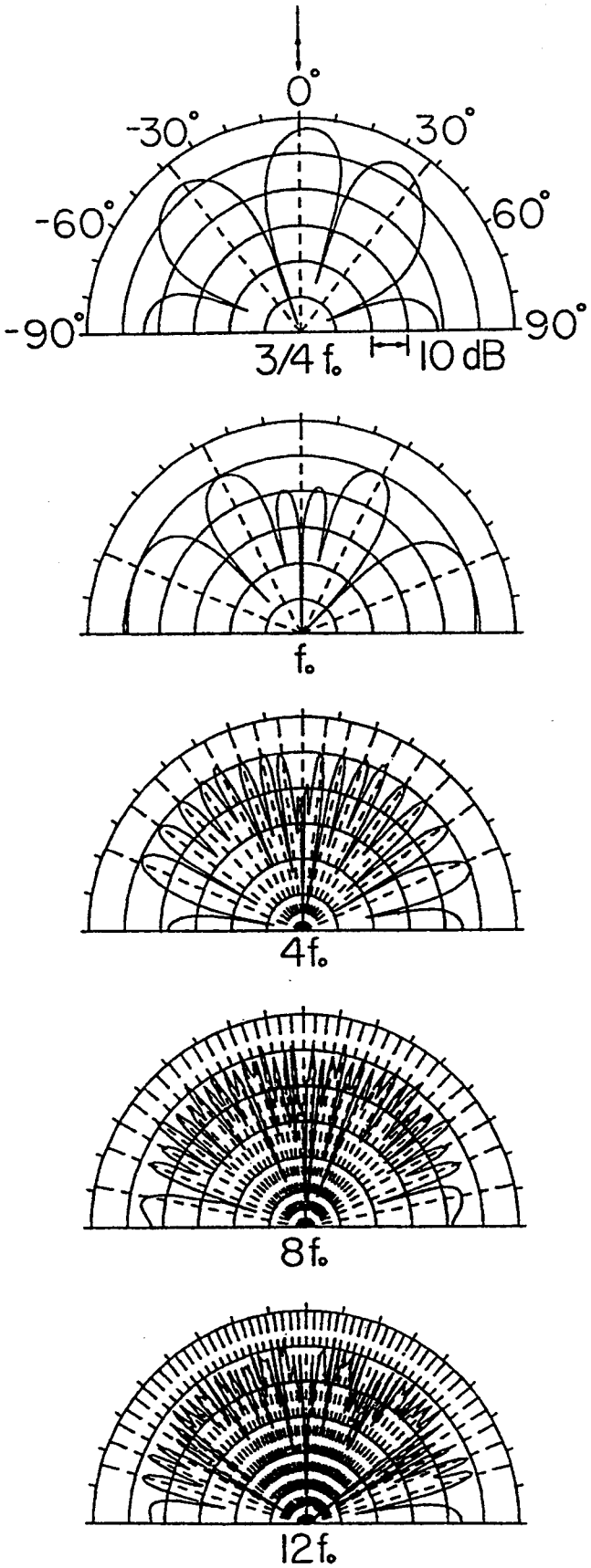
FIG. 9 shows diffraction patterns at $\frac{3}{4}$, 1, 4, 8 and 12 times the design frequency for a primitive root diffusor.

In developing the present invention, careful attention has been directed to not only developing a two-dimensional primitive root diffusor with advantageous acoustical characteristics but also to develop such a two-dimensional primitive root diffusor which is aesthetically pleasing and which may be incorporated into existing room configurations. As such, in a first aspect, it has been found that existing suspended ceiling grid systems typically have square openings which have the dimensions 2′×2′. As such, in the preferred embodiment of the present invention, these outer dimensions are employed.

Concerning aesthetics, Applicants have found that acoustical functionality may be maintained while providing aesthetic appearance when a two-dimensional primitive root diffusor is molded. Additionally, molding of the diffusor saves costs since fabrication of a diffusor having a large number of wells each of which has a unique depth can be extremely time consuming and, thus, expensive.

In order for the inventive primitive root diffusor to be effective in its intended environments, it must scatter sound over a bandwidth of at least 500 to 5,000 cycles per second. Furthermore, Applicants have ensured that each primitive root diffusor has a class A ASTM E-84 rating, namely, flame spread: 25 feet; and a smoke developed index of 450 compared to red oak.

In accordance with the teachings of the present invention, each diffusor in dimensions of 2′×2′ weighs less than 25 pounds while being stiff enough to minimize diaphragmatic absorption.

Given the design constraint requiring each diffusor to be of generally square configuration, each of the cells thereof was made rectangular with an aspect ratio which camouflages the non-square cross-section thereof. In examining prime numbers which could be employed in calculating the depths of the respective wells, several different prime numbers were tested. It was found that the higher the prime number employed, the more subtle the non-square cross-section of the wells would be. Through experimentation, Applicants have found that an effective primitive root diffusor may be made from calculations where the prime number is 157 whereby N−1 equals 156, providing prime cofactors of 12×13. The 156 rectangular blocks defining the acoustical wells provide a very balanced and aesthetic surface topology and the non-square aspect ratio is indiscernible at reasonable viewing distances.

In addition, Applicants devised an algorithm which could be used to determine the primitive root of 157, and this primitive root was calculated to be g=5. The algorithm is also employed to calculate the sequence values since exponentiation of the primitive root g=5 is beyond the capability of most computers which cannot display the results of calculating $5^{156}$. Table 3 below reproduces the algorithm which is so employed.

TABLE 3

```
      dimension idif(200,200),id(13,12),
      idd(13,12),ip(30),idis(30)
      dimension ipp(30)
      dimension idc(156)
c
      open(unit=20,file='out.dat'  ,form='formatted',
      status='unknown')
C
      ipr=157
      irt=5
      ni=13
      nj=12
c
      ii=0
      jj=0
      mmod=1
      do 20 n=1,ipr-1
      mmod=mmod*irt
      mmod=mod(mmod,ipr)
      iii=mod(ii,ni)+1
      jjj=mod(jj,nj)+1
      id(iii,jjj)=n
      idd(iii,jjj)=mmod
```

TABLE 3-continued

```
      idc(mmod)=idc(mmod)+1
      ii = ii+1
      jj=jj+1
   20 continue
c
   40 continue
      do 300 j=1,nj
      write(20,310) (id(i,j),i=1,ni)
  310 format(2x,13i4)
  300 continue
      write(20,330)
  330 format (//)
      do 320 j=1,nj
      write(20,310) (idd(i,j),i=1,ni)
  320 continue
      do 857 i=1,ipr-1
  857 write(20,310)i,idc(i)
      close(20)
      end
```

In the example described above which is the preferred embodiment of the present invention, the values of the depths of the wells in the inventive diffusor are calculated by employing the algorithm described in Table 3. Before performing the calculations employing the algorithm shown in Table 3, a 12×13 matrix was created showing the locations for the wells 1 through 156 on the matrix following the instructions set forth hereinabove wherein the numbers precede diagonally at −45° until reaching the last possible spot whereupon the top of the next column is employed to continue the sequence, and when the last column has been employed going to the next available row in the first column.

TABLE 4

| | | | | | | | | | | | | |
|---|---|---|---|---|---|---|---|---|---|---|---|---|
| 1 | 145 | 133 | 121 | 109 | 97 | 85 | 73 | 61 | 49 | 37 | 25 | 13 |
| 14 | 2 | 146 | 134 | 122 | 110 | 98 | 86 | 74 | 62 | 50 | 38 | 26 |
| 27 | 15 | 3 | 147 | 135 | 123 | 111 | 99 | 87 | 75 | 63 | 51 | 39 |
| 40 | 28 | 16 | 4 | 148 | 136 | 124 | 112 | 100 | 88 | 76 | 64 | 52 |
| 53 | 41 | 29 | 17 | 5 | 149 | 137 | 125 | 113 | 101 | 89 | 77 | 65 |
| 66 | 54 | 42 | 30 | 18 | 6 | 150 | 138 | 126 | 114 | 102 | 90 | 78 |
| 79 | 67 | 55 | 43 | 31 | 19 | 7 | 151 | 139 | 127 | 115 | 103 | 91 |
| 92 | 80 | 68 | 56 | 44 | 32 | 20 | 8 | 152 | 140 | 128 | 116 | 104 |
| 105 | 93 | 81 | 69 | 57 | 45 | 33 | 21 | 9 | 153 | 141 | 129 | 117 |
| 118 | 106 | 94 | 82 | 70 | 58 | 46 | 34 | 22 | 10 | 154 | 142 | 130 |
| 131 | 119 | 107 | 95 | 83 | 71 | 59 | 47 | 35 | 23 | 11 | 155 | 143 |
| 144 | 132 | 120 | 108 | 96 | 84 | 72 | 60 | 48 | 36 | 24 | 12 | 156 |

Thus, referring to Table 4, well 1 is at the upper left hand corner of the matrix and wells 2 through 12 precede diagonally through the matrix until the bottom row has been reached whereupon well 13 is located at the top of the last row. Since well 13 is at the top of the last column, well 14 is located at the highest location on the first column, to-wit, just below well 1. Wells 15 through 24 precede diagonally at the −45° angle and after the well 24, of course, the well 25 is at the top of the next column with the well 26 being located below the well 13. After the well 26, the well 27 is naturally located in the third position of the first column and the numbering sequence continues as shown until all 156 wells have been properly located.

In this preferred example, with the number of wells totalling 156 and with g, the primitive root, equalling 5, the specific numerical depth values for the wells are calculated as follows:

(1) The primitive root is raised to the power of the number of the particular well chosen. For example, for well 3, one takes the primitive root 5 and raises it to the third power. The resulting number 125 is divided by the chosen prime number 157 which leaves a total of 0.7961783. When this last-mentioned number is multiplied times the prime number 157, the residue is 125.

TABLE 5

| | | | | | | | | | | | | |
|---|---|---|---|---|---|---|---|---|---|---|---|---|
| 5 | 151 | 70 | 73 | 38 | 80 | 61 | 21 | 69 | 137 | 24 | 34 | 22 |
| 110 | 25 | 127 | 36 | 51 | 33 | 86 | 148 | 105 | 31 | 57 | 120 | 13 |
| 65 | 79 | 125 | 7 | 23 | 98 | 8 | 116 | 112 | 54 | 155 | 128 | 129 |
| 17 | 11 | 81 | 154 | 35 | 115 | 19 | 40 | 109 | 89 | 113 | 147 | 12 |
| 60 | 85 | 55 | 91 | 142 | 18 | 104 | 95 | 43 | 74 | 131 | 94 | 107 |
| 64 | 143 | 111 | 118 | 141 | 82 | 90 | 49 | 4 | 58 | 56 | 27 | 156 |
| 152 | 6 | 87 | 84 | 119 | 77 | 96 | 136 | 88 | 20 | 133 | 123 | 135 |
| 47 | 132 | 30 | 121 | 106 | 124 | 71 | 9 | 52 | 126 | 100 | 37 | 144 |
| 92 | 78 | 32 | 150 | 134 | 59 | 149 | 41 | 45 | 103 | 2 | 29 | 28 |
| 140 | 146 | 76 | 3 | 122 | 42 | 138 | 117 | 48 | 68 | 44 | 10 | 145 |
| 97 | 72 | 102 | 66 | 15 | 139 | 53 | 62 | 114 | 83 | 26 | 63 | 50 |
| 93 | 14 | 46 | 39 | 16 | 75 | 67 | 108 | 153 | 99 | 101 | 130 | 1 |

Thus, in Table 5, in the position corresponding to the number 3 in Table 4, the number 125 is placed corresponding to the depth of the well at that position.

In another example, where the well number h equals 6, $g^h$ equals $5^6$ equals 15,625 which when divided by 157 equals 99.522292. In this case, the residue, to the right of the decimal point, is .522292 which when multiplied by 157 yields 82. As shown in Table 5, the number 82 has been placed at the same location as the number 6 in Table 4.

As such, it is important to note that after raising the primitive root to the power corresponding to the well number and after dividing the resulting sum by the prime number, in this case, 157, the value to the right of the decimal point, the residue, is multiplied by the prime number 157 and the resulting sum is the corresponding sequence value for that well number. Each sequence value is multiplied by the design wavelength, λ, and divided by twice the prime number (157 for Table 5) to arrive at the actual well depth value. As should be understood, the algorithm shown in Table 3 was created since raising the primitive root g to high powers based upon the use of 156 wells in the preferred design, is beyond the capability of most computers.

The primitive root is a prime number less than N which, by trial and error, is found, when employing the primitive root sequence formula or the algorithm of Table 3, to cause the matrix of Table 5 to be formed.

Applicants have found that only one such prime number will yield these results.

With reference, now, to FIGS. 10–27, the specific diffusor having the values illustrated in Table 5 is shown.

In viewing FIGS. 10–27, certain representative ones of the wells having the numbers displayed in Table 4 and having the well depth values displayed in Table 5 are shown with the reference numerals corresponding to the numbers in Table 4.

Figure 10:
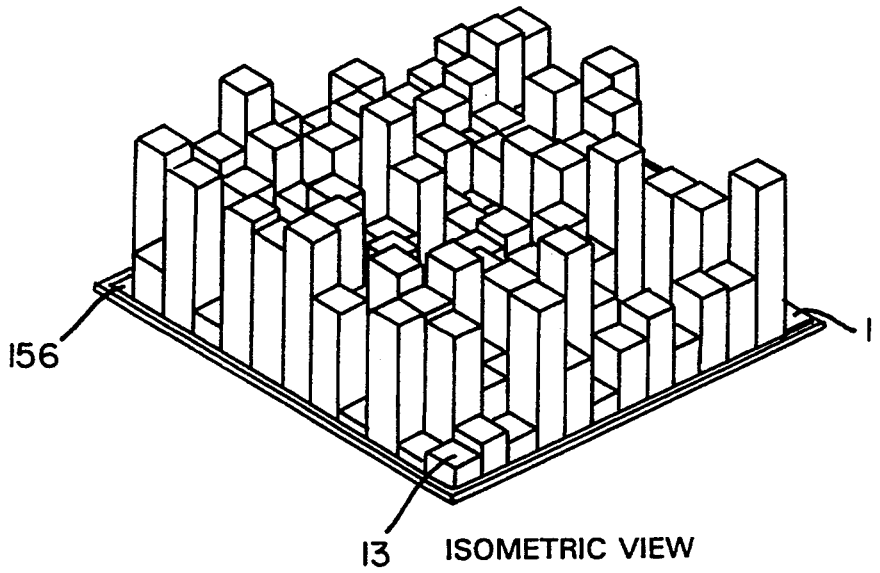
FIG. 10 shows an isometric view of a two-dimensional primitive root diffusor made in accordance with the teachings of the present invention.
Figure 11:
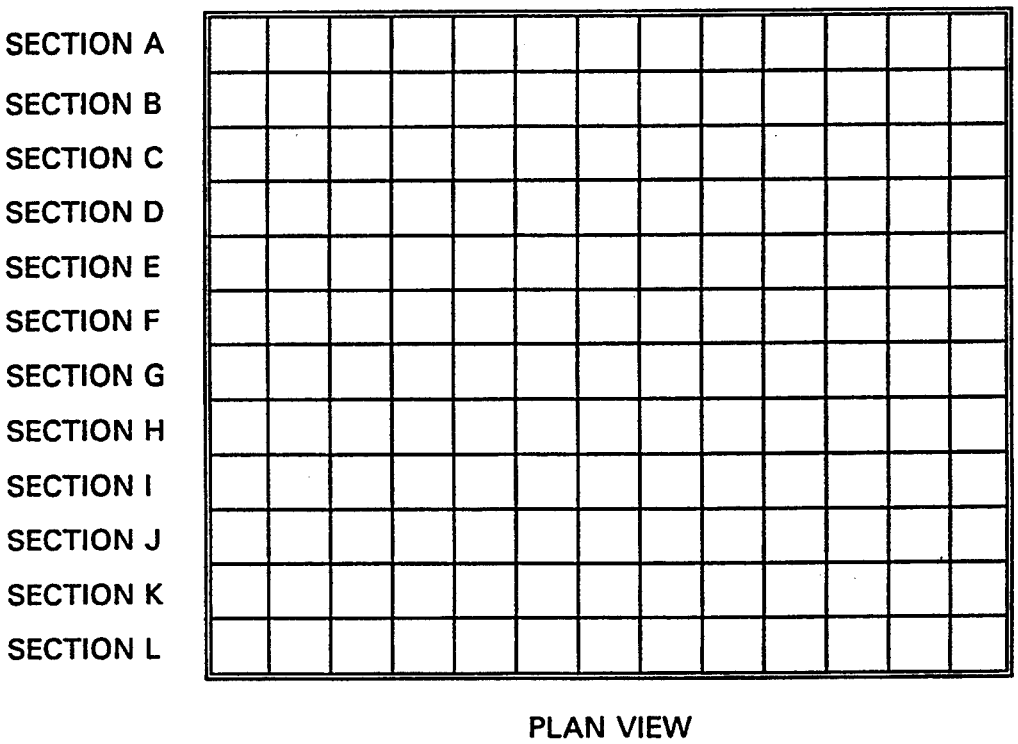
FIG. 11 shows a plan view of the primitive root diffusor of FIG. 10.
Figure 12:
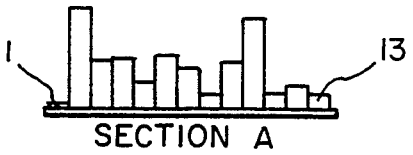
FIGS. 12–23 show the respective sections A–L as depicted in FIG. 11.
Figure 13:
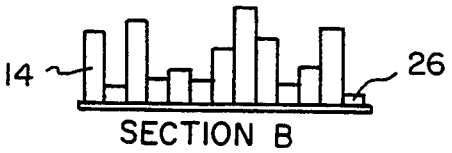
Figure 14:
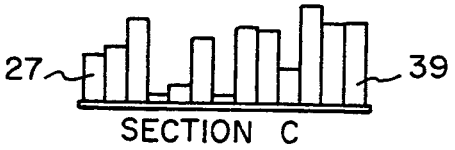
Figure 15:
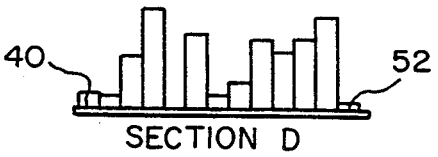
Figure 16:
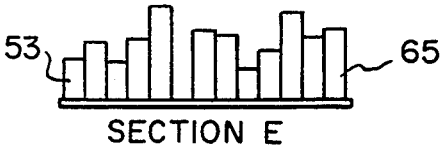
Figure 17:
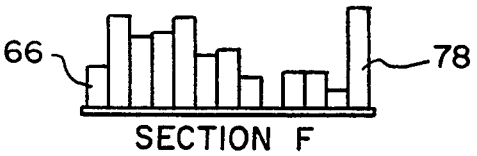
Figure 18:
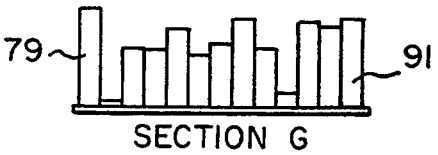
Figure 19:
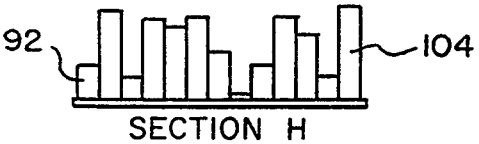
Figure 20:
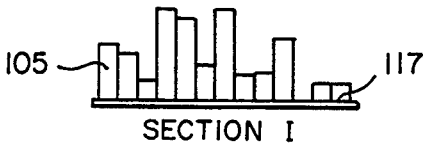
Figure 21:
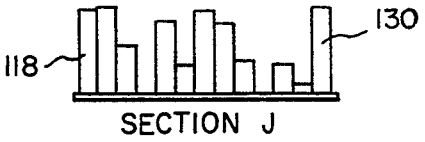
Figure 22:
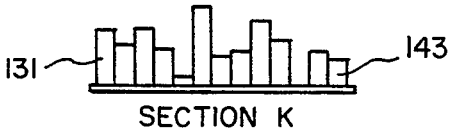
Figure 23:
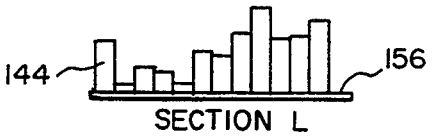
Figure 24:
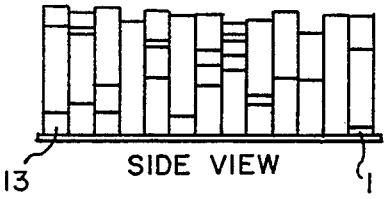
FIGS. 24–27 show four respective side views of the inventive primitive root diffusor.
Figure 25:
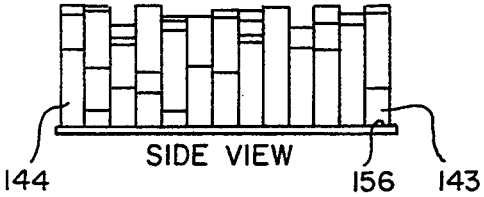
Figure 26:
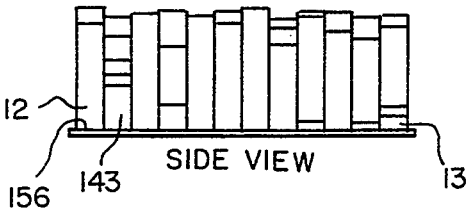
Figure 27:
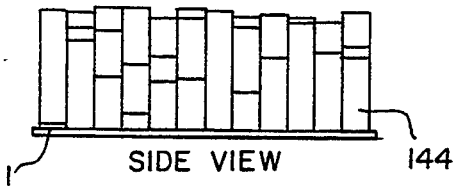

FIG. 10 shows an isometric view of the 12×13 two-dimensional primitive root diffusor which forms the preferred embodiment of the present invention. FIG. 11 shows a plan view of the diffusor of FIG. 10 looking up from below. FIGS. 12–23 show the respective sections identified in FIG. 11 by the letters A–L. In correlating FIGS. 12–23 to FIG. 10, reference is, again, made to Table 4 hereinabove. The reference numerals in FIGS. 12–23 correspond to the well identification numbers in Table 4, and for ease of understanding FIGS. 12–23, the well identification numbers at each end of each section line are shown in FIGS. 12–23.

FIGS. 24–27 show four side views from each side of the inventive diffusor best illustrated in FIG. 10. For ease of understanding the perspectives from which these side views are taken, the well identification numbers from Table 4 at each end of the first row in each side view are identified.

Figure 28:
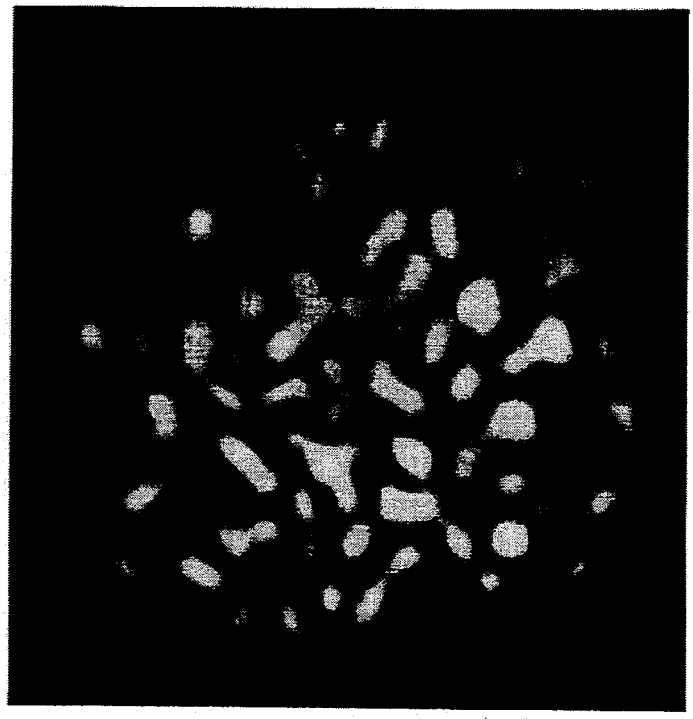
FIG. 28 shows the theoretical far-field diffraction pattern from one period of a two-dimensional primitive root diffusor based on N=157 and g=5.

FIG. 28 shows the far-field theoretical diffraction pattern for a single diffusor such as that which is illustrated in FIGS. 10–27. It is important to note that the center of the pattern is devoid of any bright spot signifying the absence of the central specularly reflective lobe as would be expected of a two-dimensional primitive root-based diffusor.

Figure 29:
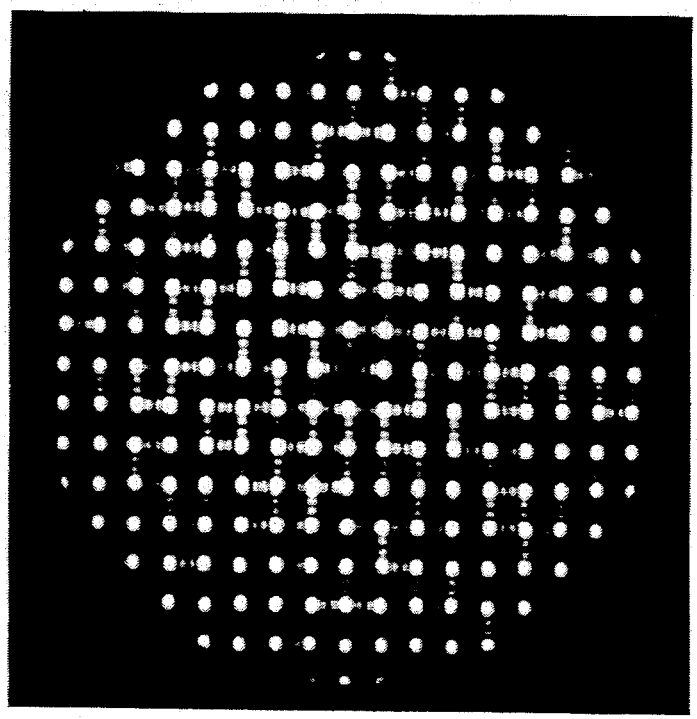
FIG. 29 shows the theoretical far-field diffraction pattern from a 3×3 array of two-dimensional primitive root diffusors based on N=157 and g=5.

FIG. 29 shows the far-field diffraction pattern at the design frequency for an array of diffusors such as that which is illustrated in FIGS. 10–27, with the array including three rows and three columns of diffusors. Again, it is important to note the absence of a central specularly reflective lobe and the resultant reduction of specular response at the center of the pattern.

In the preferred embodiment of the present invention, each diffusor must be made at low costs to be marketable and must also be lightweight and fire-retardant to render it suitable for installation in a building. Under these circumstances, in the preferred embodiment of the present invention, each inventive diffusor is made in a molding process. Applicants have found that using glass reinforced gypsum or glass reinforced plastic are suitable approaches. The glass reinforced gypsum molding process utilizes a hydraulic two-part mold using a lightweight gypsum-glass mixture for strength and lightweight. The glass reinforced plastic process utilizes a special composite two-part mold to produce a diffusor with virtually no draft angle on the vertical rise of the various rectangular blocks. To meet ASTM E-84 requirements, these fire-retardant formulations were employed.

In a further aspect, Applicants have found primitive root diffusors made in accordance with the teachings of the present invention to be extremely effective when used in conjunction with the variable acoustics modular performance system described and claimed in Applicants' prior U.S. Pat. No. 5,168,129.

Accordingly, an invention has been disclosed in terms of a preferred embodiment thereof which fulfills each and every one of the objects of the invention as set forth hereinabove and provides a new and useful two-dimensional primitive root diffusor of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

We claim:

1. A method of making a two-dimensional primitive root diffusor, including the steps of:

a) choosing a prime number N such that the number N−1 has two coprime factors X and Y which are non-divisible into each other;

b) determining a primitive root number g based upon a chosen said prime number N;

c) creating a rectangular matrix having dimensions X by Y, said matrix having N−1 spaces therein;

d) filling said spaces with integers "h" from 1 to N−1 by placing the number 1 in an upper left hand corner of said matrix and placing consecutive integers thereafter diagonally in a direction −45° with respect to a horizontal row of said matrix, whereupon, when an integer has been placed in a bottom row of said matrix and in a particular column, placing a next integer in an adjacent column rightward of said particular column and in a top row of said matrix, thereafter, placing consecutive integers diagonally from said next integer in said −45° direction until an integer has been placed in a right hand-most column of said matrix, whereupon a further next integer is placed below said number 1 and thereafter continuing until all spaces of said matrix are filled;

e) calculating a sequence value for each said integer by calculating the formula:

$$\frac{g^h}{N},$$

thereafter subtracting a total whole number portion of the result and multiplying the residue times N, resulting in obtaining of a sequence value $S_h$;

f) multiplying each sequence value by a design wavelength, λ, and dividing by 2N to transform each sequence value to a well depth value; and g) creating a two-dimensional primitive root diffusor having well depth values so calculated, including the steps of:

i) creating a diffusor structure having a square periphery;

ii) creating wells within said square periphery in rows and columns in a diffusor matrix having dimensions X by Y; and iii ) creating each of said wells having a rectangular non-square periphery;

iv) each of said wells being defined by a projection extending along an axis and having a flat top located in a plane perpendicular to said axis.

2. The method of claim 1, wherein N=157.

3. The method of claim 2, wherein g=5.

4. The method of claim 3, wherein X=13 and Y=12.

5. The method of claim 3, wherein X=12 and Y=13.

6. The method of claim 4, wherein said steps d) and e) are carried out through operation of the following algorithm:

```
      dimension idif(200,200),id(13,12),
      idd(13,12),ip(30),idis(30)
      dimension ipp(30)
      dimension idc(156)
c
      open(unit=20,file='out.dat'  ,form='formatted',
      status='unknown')
C
      ipr=157
      irt=5
      ni=13
      nj=12
c
      ii=0
      jj=0
      mmod=1
      do 20 n=1,ipr-1
      mmod=mmod*irt
      mmod=mod(mmod,ipr)
      iii=mod(ii,ni)+1
      jjj=mod(jj,nj)+1
      id(iii,jjj)=n
      idd(iii,jjj)=mmod
      idc(mmod)=idc(mmod)+1
      ii=ii+1
      jj=jj+1
   20 continue
c
   40 continue
      do 300 j=1,nj
      write(20,310) (id(i,j),i=1,ni)
  310 format(2x,13i4)
  300 continue
      write(20,330)
  330 format (//)
      do 320 j=1,nj
      write(20,310) (idd(i,j),i=1,ni)
  320 continue
        do 857 i=1,ipr-1
  857 write(20,310)i,idc(i)
      close(20)
```

-continued

```
      end
```

7. A two-dimensional primitive root diffusor comprising a two-dimensional matrix of wells having respective depths calculated in accordance with the formula:

$$S_h = g^h{}_{modN},$$

where $S_h$ is a particular sequence value,

N is a prime number, h is an integer from 1 to N−1, and g is a primitive root of N, said diffusor being square with said matrix having dimensions X and Y where X and Y are unequal, each of said wells having a rectangular non-square periphery and being defined by a protection extending along an axis and having a flat top located in a plane perpendicular to said axis.

8. The diffusor of claim 7, wherein g=5, and

N=157.

9. The diffusor of claim 8, wherein said matrix has dimensions X and Y.

10. The diffusor of claim 9, wherein

X=13, and

Y=12.

11. The diffusor of claim 7, made of glass reinforced gypsum.

12. The diffusor of claim 7, made of glass reinforced plastic.

13. The method of claim 1, further including the step of providing each said projection with outer walls which minimize a draft angle thereof.

14. The diffusor of claim 7, wherein each said projection has side walls defining a minimal draft angle.

* * * * *